US012649981B2

(12) United States Patent
Qi et al.

(10) Patent No.: US 12,649,981 B2
(45) Date of Patent: Jun. 9, 2026

(54) PREPARATION METHOD OF COLLAGEN FIBER, COLLAGEN FIBER, AND APPLICATION OF COLLAGEN FIBER

(71) Applicant: ZHEJIANG HEURISTIC NEW MATERIAL TECHNOLOGY LIMITED-LIABILITY COMPANY, Ningbo (CN)

(72) Inventors: Yufeng Qi, Ningbo (CN); Wenguang He, Ningbo (CN); Huaicang Zhang, Ningbo (CN)

(73) Assignee: ZHEJIANG HEURISTIC NEW MATERIAL TECHNOLOGY LIMITED-LIABILITY COMPANY, Ningbo (CN)

( * ) Notice: Subject to any disclaimer, the term of this patent is extended or adjusted under 35 U.S.C. 154(b) by 125 days.

(21) Appl. No.: 18/724,605

(22) PCT Filed: Nov. 7, 2022

(86) PCT No.: PCT/CN2022/130397
§ 371 (c)(1),
(2) Date: Jun. 26, 2024

(87) PCT Pub. No.: WO2023/138166
PCT Pub. Date: Jul. 27, 2023

(65) Prior Publication Data

US 2025/0066953 A1 Feb. 27, 2025

(30) Foreign Application Priority Data

Jan. 24, 2022 (CN) ..... 202210081156.1

(51) Int. Cl.
*D01D 5/06* (2006.01)
*D01D 1/02* (2006.01)
*D01F 4/00* (2006.01)

(52) U.S. Cl.
CPC ..... *D01D 5/06* (2013.01); *D01D 1/02* (2013.01); *D01F 4/00* (2013.01); *D10B 2211/06* (2013.01)

(58) Field of Classification Search
CPC ..... D01D 1/02; D01D 5/0046
See application file for complete search history.

(56) References Cited

U.S. PATENT DOCUMENTS 2,475,128 A * 7/1949 Cresswell ..... D01D 4/022 425/461
2005/0054830 A1* 3/2005 Islam ..... D01F 4/02 530/353
2008/0254199 A1* 10/2008 Orcutt ..... A23P 30/20 426/656
2009/0087469 A1* 4/2009 Zhang ..... A61K 9/0024 514/23
2010/0215939 A1* 8/2010 Westbroek ..... D04H 3/16 428/292.1
2012/0048769 A1* 3/2012 Sivik ..... A61Q 5/00 206/524.1
2012/0172831 A1* 7/2012 Darcy ..... A61K 47/10 604/500
2012/0273993 A1* 11/2012 Shoseyov ..... D01F 4/00 530/356
2013/0079285 A1* 3/2013 Satoh ..... A61K 8/027 514/17.2
2014/0326165 A1* 11/2014 Saleh ..... C07K 14/78 524/21
2017/0007741 A1* 1/2017 D'Lima ..... A61L 27/20
2017/0203484 A1* 7/2017 Grigoryev ..... D01D 5/0076
2017/0247430 A1* 8/2017 Yost ..... C07K 14/78
2018/0193524 A1* 7/2018 Shoseyov ..... C07K 14/78
2019/0002644 A1* 1/2019 Ohta ..... C12N 15/70

* cited by examiner

*Primary Examiner* — Andrew D Graham

(57) ABSTRACT

A preparation method for a collagen fiber, a collagen fiber, and a use. The method comprise the following steps: (1) spinning stock solution preparation: soaking a collagen material in a dissolving solution having a pH value of 3.5 to 5.5 for dissolution, and adjusting the pH value to 9.9 to 12.5, thereby forming a spinning stock solution; and (2) nascent fiber preparation: enabling the spinning stock solution to enter a coagulation bath having a pH value of 4.4 to 6.8 for coagulation and spinning, thereby forming nascent fibers. By means of multiple times of pH value adjustment, a collagen salting-out environment is formed, and the collagen fiber having spinnability is prepared by means of wet spinning.

13 Claims, No Drawings

PREPARATION METHOD OF COLLAGEN FIBER, COLLAGEN FIBER, AND APPLICATION OF COLLAGEN FIBER

FIELD OF INVENTION

The present application relates to the technical field of new materials, and more specifically, it relates to a preparation method of collagen fiber, a collagen fiber, and an application of collagen fiber.

DESCRIPTION OF RELATED ARTS

Collagen is a type of protein, composed of α-amino acids. It is mainly found in the skin, bones, teeth, tendons, ligaments and blood vessels of animals. It is an important component and functional substance of connective tissue.

The tropocollagen molecule, the basic structural unit of collagen, has a diameter of about 115 nm, a length of about 280-300 nm, and a relative molecular weight of about 30 kDa. Collagen has a three-strand rod-shaped superhelical structure, consisting of three α-chain polypeptides, and each collagen chain has a left-handed helical configuration. The three polypeptide chains are then interlocked with each other through hydrogen bonds to form a very stable right-handed helix structure. There are forces such as ionic bonds, hydrogen bonds, van der Waals forces, and hydrophobic bonds generated by non-polar groups between the unique rod-shaped helical structure of collagen and the collagen peptide chains.

Collagen molecules are capable of self-assembly into supramolecular forms, and this self-assembly is formed by five triple-helical collagen molecules arranged staggered by quarters and highly oriented to have a D-period band-like space, where each D-period is approximately 67 nm. Telopeptides are composed of non-helical regions of about 20 amino acid residues in length and play an important role in fibril formation, forming mature collagen molecules through cross-linking.

Fibril-forming collagens include types I, II, III, V, and XI collagen. These collagens are characterized by their assembly into highly oriented supramolecular aggregates with typical superstructure. The diameter of this typical quarter-staggered fibril array is between 25 nm and 400 nm. Type I collagen is the most abundant and most studied collagen.

Because most type I collagen has a cross-linked structure in animal tendons, skin, ligaments, and cornea, and exists in the form of fibers with a high degree of cross-linking. They are intertwined with each other to form a network structure. This type of collagen is basically insoluble in water.

In the wet spinning process, the spinning liquid is extruded from the spinneret after being dissolved, degassed, and filtered, and directly enters the coagulation bath, and then is stretched, washed, and dried before winding and forming. If the breaking strength of the raw filaments obtained after spinning, coagulation, drafting and other processes of the spinning solution is less than 1.99 cN/dtex, there is basically no spinnability.

SUMMARY OF THE PRESENT INVENTION

In order to prepare spinnable collagen fibers and realize industrial production of collagen fibers, this application provides a preparation method of collagen fibers, a collagen fiber, and an application of collagen fibers.

In the first aspect, this application provides a method for preparing collagen fibers, adopting the following technical solution:

A method for preparing collagen fibers, including the following steps:

(1) Spinning Solution

Soaking the collagen material in a solution with a pH of 3.5 to 5.5 and dissolve it, then adjust the pH to 9.9 to 12.5 to form a spinning solution;

(2) as-Spun Fiber

Coagulation spinning the spinning solution in a coagulation bath with a pH of 4.4-6.8 to form as-spun fiber.

By adopting the above technical solution, after the collagen material is dissolved in the acidic solution, when the acidic solution is adjusted to be alkaline, the reaction of the acid-base solution will generate salt, thus providing a collagen salting-out environment; further, when the alkaline solution is When the spinning dope enters the acidic coagulation bath, the acid solution reacts again to generate salts and provide a salting-out environment for collagen. Collagen is rapidly precipitated from the spinning solution and solidified to form as-spun fiber. After conventional post-processing such as wet drafting, dry drafting, and qualitative analysis, collagen fibers with fibril breaking strength >1.99 cN/dtex can be obtained, that is, collagen fibers with spinnability can be obtained.

Wherein, among them, the isoelectric point that is the pH at which the net charge on the surface of collagen is zero of collagen is in the coagulation bath pH range of 4.4~6.8. Therefore, when the spinning solution enters the coagulation bath whose pH is the isoelectric point of collagen, the solubility of collagen is minimal, and collagen is more likely to aggregate and precipitate, thereby accelerating salting out and solidifying into fibers quickly.

Therefore, in this application, the pH of the solution, the pH of the spinning solution, and the pH of the coagulation bath are adjusted to salt out the collagen, thereby rapidly solidifying it into spinnable collagen fibers. In addition, this application does not require additional toxic cross-linking agents, has a faster reaction speed, and is suitable for continuous production.

Preferably, the coagulation bath comprises the following percentage of substances by weight: protein solidifying agent 8-12%, dehydrating agent 36-47%, pH regulator 0.8-3%.

By adopting the above technical solution, the protein solidifying agent can coagulate collagen. Dehydrating agent can further enhance the salting-out effect. On the one hand, they compete with proteins for water molecules and destroy the water film on the surface of protein colloid particles; on the other hand, they neutralize a large number of charges on protein particles, causing protein particles in the water to accumulate and precipitate. The pH regulator can adjust the pH of the coagulation bath to the isoelectric point of collagen, making it easier for collagen to aggregate and precipitate.

Preferably, the coagulthe coagulation bath comprises the following percentage of substances by weight: protein solidifying agent 8-12%, dehydrating agent 36-47%, pH regulator 0.8-3%, and 1.2-5% zinc salt.

By adopting the above technical solution, when the dehydrating agent is sodium salt or potassium salt, the spinning solution will disperse too quickly in the coagulation bath, resulting in excessive rigidity of the as-spun fiber and making the later fiber brittle, which is not conducive to spinnability. Adding zinc salt can ease the rapid dispersion of sodium and potassium ions and improve the tensile properties of the fiber.

Preferably, the dehydrating agent is a strong electrolyte salt.

By adopting the above technical solution, the strong electrolyte salt can be completely ionized in the water, so that it can fully compete with collagen for water, making it easier for collagen in the water to precipitate.

Preferably, the dehydrating agent is one or a mixture of several of sodium salt, potassium salt, and ammonium salt.

By adopting the above technical solution, sodium salt, potassium salt and ammonium salt are easily available and facilitate industrial production.

Preferably, the sodium salt is one or a mixture of several of sodium sulfate, sodium chloride, and sodium nitrate.

Preferably, the potassium salt is one or a mixture of several of potassium sulfate, potassium chloride, and potassium nitrate.

Preferably, the ammonium salt is one or a mixture of several of ammonium sulfate, ammonium chloride, and ammonium nitrate.

Preferably, the pH regulator is a strong acid.

By adopting the above technical solution, strong acid can easily produce salt with the alkaline spinning solution, thereby increasing the salt concentration of the coagulation bath. As the salt concentration increases, collagen is easier to precipitate.

Preferably, the pH regulator is one or a mixture of several of sulfuric acid, hydrochloric acid, and nitric acid.

Preferably, the zinc salt is one or a mixture of several of zinc sulfate, zinc chloride, and zinc nitrate.

Preferably, the solution includes protease and water, and the mass ratio of the protease and water is (0.2-0.5):(6-10).

By adopting the above technical solution, collagen exists in the form of a network cross-linked structure. The enzyme preparation in the solution can selectively cut off the telopeptides of collagen without affecting the helical segments. This ensures that the triple helix structure of collagen is not destroyed and the collagen can be dissolved to achieve the purpose of extracting collagen.

Preferably, the mass ratio of the collagen material, protease and water is (1-2):(0.2-0.5):(6-10).

Preferably, the protease is one or a mixture of several of pepsin, trypsin, and papain.

Preferably, a weak acid is used to adjust the pH of the solution.

By adopting the above solution, the weak acid is milder, improving the stability of the solution and reducing the impact on collagen activity.

Preferably, the weak acid is carboxylic acid.

By adopting the above technical solution, carboxylic acid and collagen easily form hydrogen bonds, which has little impact on collagen activity; furthermore, when adjusting the pH of the spinning solution, the carboxylic acid reacts with the alkali to generate salt and water, and the salt concentration increases, which further facilitates the salting out of collagen into filaments.

Preferably, the mass ratio of the collagen material, protease and water is (1-2):(0.2-0.5):(6-10).

Preferably, in step (1), a strong base is used to adjust the pH of the spinning solution.

By adopting the above technical solution, the reaction between strong alkali of spinning solution and strong acid of coagulation bath can produce neutral salt, which can be used as strong electrolyte to provide a salt-out environment for collagen, precipitate collagen quickly from spinning stock and form fiber, thus improving the spinnability of collagen fiber.

Preferably, the collagen material is prepared by the following method: soaking the original collagen material in sodium carbonate solution.

By adopting the above technical solution, after the original collagen material is soaked in sodium carbonate, the collagen of the original collagen material can be activated and decolored, thereby facilitating the subsequent enzymatic hydrolysis and extraction of collagen.

Preferably, the procollagen material is derived from one or a mixture of several of animal tendon, skin, and ligament.

Preferably, in step (2), the as-spun fiber was negatively drawn in the coagulation bath according to the spinning speed:bath leaving speed of (1-1.5):(0.5-0.9).

By adopting the above technical solution, since the crystallinity of collagen spinning is high and the collagen fibers are relatively brittle, the breaking strength of primary fibers and collagen fibers can be increased according to the above negative drafting rate, thereby reducing wire breakage.

In the second aspect, this application provides a collagen fiber using the following technical solution:

A collagen fiber made by using the above preparation method of collagen fiber.

By adopting the above technical solution, the collagen fiber fibrils produced by the preparation method of the present application have a breaking strength of >1.99 cN/dtex and are spinnable.

In the third aspect, this application provides the application of the above-mentioned collagen fiber, adopting the following technical solution:

The above-mentioned collagen fiber is used in non-woven fields such as facial masks, sanitary napkins, diapers, underarm patches, etc.;

The above-mentioned collagen fiber is used in textile fields such as underwear, socks, shorts, clothing fabrics and bedding, etc. Compared with general plant protein, collagen fiber is more suitable for spinning to produce protein fiber, and has excellent moisture retention, good affinity with human skin, and comfortable wearing. It is suitable for the development of bedding, shirts, knitted underwear, socks and other products.

The above-mentioned collagen fiber is used in medical fields such as band-aids, bandages, dressings, etc., and has good anti-seepage and healing functions.

The above-mentioned collagen fiber is used in the food field, such as preservatives in the food field, fruit preservation bags, etc. It can also be used in artificial leather.

The above-mentioned collagen fiber is used in paper industry: it is mainly in the form of fibers and combined with plant fibers to form composite products used to improve paper strength, water absorption, air permeability, tightness and whiteness, etc.

The above-mentioned collagen fiber is used in composite materials and nanomaterials, collagen fibers have good film-forming properties in addition to blending and spinning with other polymer materials.

To sum up, this application has the following beneficial effects:

1. This application provides a collagen salting-out environment by adjusting the pH of the solution, the pH of the spinning solution and the pH of the coagulation bath, so that the collagen can be quickly solidified into spinnable collagen fibers.

2. This application extracts collagen from the original collagen material through acidic enzymatic hydrolysis, and cooperates with pH adjustment to obtain a spinning stock solution without using a cross-linking agent, and can be adapted to continuous and industrial production.

3. The collagen fiber produced by this application has wide application and strong plasticity.

DETAILED DESCRIPTION OF THE PREFERRED EMBODIMENT

The present application will be further described in detail below in conjunction with embodiments.

The raw materials used in this application are all commercially available. The solution includes one or a mixture of several of pepsin, trypsin, and papain. In the embodiments of this application, pepsin with CAS number 9001-75-6 is used as an example for explanation. The chromium tanning agent was purchased from Jiangsu Bohong Chemical Co., Ltd., and the chromium content Cr 2O 3 was (25±1)%. The tropocollagen material is derived from one or a mixture of several of animal tendon, skin, and ligament. The embodiment of the present application takes cowhide as an example. Acetic acid is used as the carboxylic acid.

EMBODIMENTS

Embodiment 1-11

As shown in Table 1, the main difference between Embodiment 1-11 lies in the pH of the solution, the pH of the spinning solution, and the pH of the coagulation bath.

The following is explained taking Embodiment 1 as an example.

The preparation method of collagen fibers provided in Embodiment 1 includes the following steps:

(1) Preparation of Spinning Solution

Take 100 g of cowhide and soak it in 1000 mL of sodium carbonate solution with a concentration of 1 mg/mL for 2 hours. After taking it out, rinse the cowhide with distilled water and dry it. Use acetic acid to adjust the pH of the solution to 4.5, and keep the solution at 34° C. Put the cowhide into the solution to fully dissolve;

Wherein, the dissolving liquid is specifically a pepsin solution, and the mass ratio of pepsin and deionized water is 0.2:10. More specifically, the mass ratio of cowhide, pepsin, and deionized water is 1:0.2:10. Specifically, 100 g cowhide, 20 g pepsin, 1000 g deionized water;

Further, sodium hydroxide was used to adjust the pH to 10.9 to form an alkaline spinning solution, and the temperature of the spinning solution was controlled at 35° C.

It should be noted that other strong alkali can also be used to adjust the pH of the spinning solution; the temperature of the above-mentioned dissolving solution can be kept at the temperature suitable for pepsin activity, specifically 29-34° C., and the temperature of the spinning solution can be 32-35° C.;

The mass ratio of cowhide, pepsin and deionized water can also be (1-2):(0.2-0.5):(6-10).

(2) As-Spun Fiber

The spinning solution enters the coagulation bath with a pH of 5.9 through a wet spinning metering pump with an inlet pressure of 0.1 MPa and an outlet pressure of 1 MPa, a candle filter, a gooseneck, and a spinneret with a spinneret diameter of 0.1 mm, and perform coagulation and spinning at 20 meters/minute to form primary fibers. The primary fibers are placed in the coagulation bath and negative drafted according to the spinning speed: bath leaving speed of 1:0.7;

Wherein, the coagulation bath comprises the following percentage of substances by weight: tannic acid 10%, sodium sulfate 42%, sulfuric acid 1%, and water 47%;

The settings and parameters of the wet spinning metering pump, candle filter, gooseneck, and spinneret are all routinely adjusted by those skilled in the art according to actual production conditions. For example, the inlet pressure of the wet spinning metering pump is 0.08 to 0.11. MPa, the outlet pressure is 0.9~1.3 Mpa; the diameter of the spinneret hole is 0.05~0.12 mm, and the length of the hole channel is 0.1~0.25 mm, which will not be described again here.

(3) Collagen Fiber

The as-spun fibers are subjected to post-processing such as wet drawing, dry drawing, heat setting, etc. to obtain collagen fibers. Similarly, wet drafting, dry drafting, qualitative and other operations can be routinely adjusted by those skilled in the art according to actual production conditions, and will not be described again here.

Table 1: pH table of reaction solution of Embodiments 1-7.

TABLE 0001

| | pH of solution | pH of spinning solution | pH of coagulation bath |
|---|---|---|---|
| Embodiment 1 | 3.5 | 9.9 | 4.4 |
| Embodiment 2 | 4.5 | 9.9 | 4.4 |
| Embodiment 3 | 5.5 | 9.9 | 4.4 |
| Embodiment 4 | 4.5 | 11.2 | 4.4 |
| Embodiment 5 | 4.5 | 12.5 | 4.4 |
| Embodiment 6 | 5.5 | 11.2 | 5.5 |
| Embodiment 7 | 5.5 | 11.2 | 6.8 |
| Embodiment 8 | 4.5 | 11.2 | 6.8 |
| Embodiment 9 | 3.5 | 11.2 | 6.8 |
| Embodiment 10 | 5.5 | 9.9 | 6.8 |

Embodiments 11-16

The difference between Embodiments 11-16 and Embodiments 7 is that the proportion of the coagulation bath is different. Please see Table 2 for details.

Table 2: Coagulation bath ratio table of Embodiments 8-13.

TABLE 0002

| | protein solidifying agent % | dehydrating agent % | pH regulator % | water % |
|---|---|---|---|---|
| Embodiment 7 | 8 | 36 | 0.8 | 55.2 |
| Embodiment 11 | 10 | 36 | 0.8 | 53.2 |
| Embodiment 12 | 12 | 36 | 0.8 | 51.2 |
| Embodiment 13 | 10 | 42 | 0.8 | 47.2 |
| Embodiment 14 | 10 | 47 | 0.8 | 42.2 |
| Embodiment 15 | 10 | 42 | 1 | 47 |
| Embodiment 16 | 10 | 42 | 3 | 45 |

Embodiments 17-18

The difference between Embodiments 17-19 and Embodiment 15 is that the coagulation bath ratio is different, and the coagulation bath also includes a zinc salt. The following description takes the zinc salt as zinc sulfate as an example. Please see Table 3 for details.

Table 3: The proportioning table of the coagulation bath of Embodiments 14-16.

TABLE 0003

| | protein solidifying agent % | dehydrating agent % | pH regulator % | zinc salt % | water % |
|---|---|---|---|---|---|
| Embodiment 15 | 10 | 42 | 1 | 0 | 47 |
| Embodiment 17 | 10 | 42 | 1 | 1.2 | 45.8 |
| Embodiment 18 | 10 | 42 | 1 | 2 | 45 |
| Embodiment 19 | 10 | 42 | 1 | 5 | 42 |

Embodiments 20-24

The difference between Embodiments 20-24 and Embodiment 18 lies in the raw materials of the coagulation bath. Please see Table 4 for details.

Table 4: List of raw materials of the coagulation bath of Embodiments 17-20.

TABLE 0004

| | protein solidifying agent | dehydrating agent | pH regulator | zinc salt |
|---|---|---|---|---|
| Embodiment 18 | tannic acid | sodium sulfate | sulfuric acid | zinc sulfate |
| Embodiment 20 | tannic acid | potassium chloride | sulfuric acid | zinc sulfate |
| Embodiment 21 | tannic acid | potassium chloride | hydrochloric acid | zinc chloride |
| Embodiment 22 | chromium tanning agent | Ammonium nitrate | hydrochloric acid | zinc chloride |
| Embodiment 23 | chromium tanning agent | Potassium sulfate | Nitric acid | zinc sulfate |

Embodiment 24

The difference between Embodiment 24 and Embodiment 18 is that the as-spun fiber was negatively drafted in the coagulation bath according to the spinning speed:bath leaving speed of 1:0.5.

Embodiment 25

The difference between Embodiment 25 and Embodiment 18 is that the as-spun fiber was negatively drawn in the coagulation bath according to the spinning speed:bath leaving speed of 1.5:0.9.

COMPARATIVE

Comparative Example 1

The difference from Embodiment 2 is that the pH of the solution is 6.5.

Comparative Example 2

The difference from Embodiment 2 is that the pH of the coagulation bath is 8.5.

Comparative Example 3

The difference from Embodiment 2 is that the pH of the spinning solution is 8.5.

Performance Testing Test

According to the method recorded in GB/T 14463-2008 "Viscose Short Fibers", accordingly, test the densification dtex, dry breaking strength cN/dtex, wet breaking strength cN/dtex, dry breaking strength variation coefficient %, dry breaking elongation %, short fiber length mm, ultra-long fiber percentage %, double length fiber mg/100 g, residual sulfur content mg/100 g, and metric moisture recovery rate % in Embodiments; and test the dry breaking strength cN/dtex of Comparative Examples 1-3, and the test results are shown in Table 5 below.

TABLE 5

Performance test results table

| | Denier dtex | Dry breaking strength cN/dtex | Wet breaking strength cN/dtex | Variation coefficient of dry breaking strength % | dry breaking elongation % | short fiber length mm | ultra-long fiber percentage % | double length fiber mg/100 g | residual sulfur content mg/100 g | metric moisture recovery rate % |
|---|---|---|---|---|---|---|---|---|---|---|
| Embodiment 1 | 1.60 | 2.35 | 1.35 | 20.02 | 16.2 | 37.6 | 0.2 | 3.2 | 8.7 | 33 |
| Embodiment 2 | 1.60 | 2.27 | 1.35 | 20.02 | 16.1 | 37.6 | 0.2 | 3.2 | 8.7 | 35 |
| Embodiment 3 | 1.60 | 2.25 | 1.32 | 20.02 | 16.1 | 37.6 | 0.2 | 3.2 | 8.7 | 33 |
| Embodiment 4 | 1.60 | 2.45 | 1.37 | 20.02 | 16.1 | 37.6 | 0.2 | 3.2 | 8.7 | 33 |
| Embodiment 5 | 1.60 | 2.49 | 1.35 | 20.02 | 16.1 | 37.6 | 0.2 | 3.2 | 8.7 | 35 |
| Embodiment 6 | 1.60 | 2.43 | 1.41 | 20.02 | 15.9 | 37.6 | 0.2 | 3.2 | 8.7 | 35 |
| Embodiment 7 | 1.60 | 2.53 | 1.40 | 20.02 | 15.9 | 37.6 | 0.2 | 3.2 | 8.7 | 33 |
| Embodiment 8 | 1.60 | 2.49 | 1.39 | 20.02 | 15.9 | 37.6 | 0.2 | 3.2 | 8.7 | 33 |
| Embodiment 9 | 1.60 | 2.47 | 1.40 | 20.02 | 15.9 | 37.6 | 0.2 | 3.2 | 8.7 | 33 |
| Embodiment 10 | 1.60 | 2.45 | 1.37 | 20.02 | 15.9 | 37.6 | 0.2 | 3.2 | 8.7 | 33 |

TABLE 5-continued

Performance test results table

| | Denier dtex | Dry breaking strength cN/dtex | Wet breaking strength cN/dtex | Variation coefficient of dry breaking strength % | dry breaking elongation % | short fiber length mm | ultra-long fiber percentage % | double length fiber mg/100 g | residual sulfur content mg/100 g | metric moisture recovery rate % |
|---|---|---|---|---|---|---|---|---|---|---|
| Embodiment 11 | 1.60 | 2.52 | 1.41 | 20.02 | 15.7 | 37.6 | 0.2 | 3.2 | 8.7 | 35 |
| Embodiment 12 | 1.60 | 2.54 | 1.39 | 20.02 | 15.9 | 37.6 | 0.2 | 3.2 | 8.7 | 33 |
| Embodiment 13 | 1.60 | 2.52 | 1.41 | 20.02 | 15.5 | 37.6 | 0.2 | 3.2 | 8.7 | 34 |
| Embodiment 14 | 1.60 | 2.52 | 1.43 | 20.02 | 15.4 | 37.6 | 0.2 | 3.2 | 8.7 | 33 |
| Embodiment 15 | 1.67 | 2.55 | 1.49 | 20.02 | 15.1 | 37.6 | 0.2 | 3.2 | 8.7 | 35 |
| Embodiment 16 | 1.67 | 2.54 | 1,49 | 20.02 | 15.4 | 37.6 | 0.2 | 3.2 | 8.7 | 33 |
| Embodiment 17 | 1.77 | 2.56 | 1.51 | 20.02 | 15.1 | 37.6 | 0.2 | 3.2 | 8.7 | 34 |
| Embodiment 18 | 1.78 | 2.58 | 1.52 | 20.02 | 15.0 | 37.6 | 0.2 | 3.2 | 8.7 | 33 |
| Embodiment 19 | 1.78 | 2.57 | 1.51 | 20.02 | 15.1 | 37.6 | 0.2 | 3.2 | 8.7 | 35 |
| Embodiment 20 | 1.78 | 2.57 | 1.51 | 20.02 | 15.2 | 37.6 | 0.2 | 3.2 | 8.7 | 35 |
| Embodiment 21 | 1.78 | 2.57 | 1.50 | 20.02 | 15.1 | 37.6 | 0.2 | 3.2 | 8.7 | 33 |
| Embodiment 22 | 1.78 | 2.56 | 1.50 | 20.02 | 15.3 | 37.6 | 0.2 | 3.2 | 8.7 | 33 |
| Embodiment 23 | 1.78 | 2.55 | 1.51 | 20.02 | 15.1 | 37.6 | 0.2 | 3.2 | 8.7 | 35 |
| Embodiment 24 | 1.78 | 2.56 | 1.50 | 20.02 | 15.1 | 37.6 | 0.2 | 3.2 | 8.7 | 33 |
| Embodiment 25 | 1.78 | 2.56 | 1.51 | 20.02 | 15.2 | 37.6 | 0.2 | 3.2 | 8.7 | 34 |
| Comparative Example 1 | / | 1.21 | / | / | / | / | / | / | / | / |
| Comparative Example 2 | / | 1.18 | / | / | / | / | / | / | / | / |
| Comparative Example 3 | / | 1.24 | / | / | / | / | / | / | / | / |

According to Table 5, comparing Embodiments 1-25 and Comparative Examples 1-3, it can be seen that the selection and combination of the pH values of the solution pH, spinning solution pH, and coagulation bath pH will have a huge impact on the prepared collagen fibers. Embodiments 1-25 can all produce collagen fibers with dry breaking strengths greater than 1.99 cN/dtex, and the dry breaking strengths are all greater than 2.27. Therefore, the collagen fibers produced by the present application are fully spinnable.

In addition, according to the records in GB/T 14463-2008 "Viscose Short Fibers", the collagen fiber produced by this application can reach the index of high-quality products and has great market prospects. The dry breaking strength of the collagen fibers of Comparative Examples 1-3 was measured to be less than 1.99 cN/dtex, which indicates that the obtained collagen fibers do not have spinnability.

Secondly, it can be seen from Embodiments 1-7 that differences in the pH of the solution, the pH of the spinning solution, and the pH of the coagulation bath will affect the properties of the produced collagen fibers. In Embodiments 1-6, as the difference between the pH of the solution, the pH of the spinning solution, and the pH of the coagulation bath increases, the dry breaking strength of the produced collagen fibers increases. Comparing Embodiments 1-6 and 7, it can be seen that the pH of the coagulation bath has a greater impact on the dry breaking strength performance of collagen fibers. When the pH of the coagulation bath is within the isoelectric point range of collagen, the dry breaking strength of the produced collagen fibers is better.

By further comparing Embodiments 7-10, it can be seen that when the pH of the solution is 5.5, the pH of the spinning solution is 11.2, and the pH of the coagulation bath is 6.8, the dry breaking strength of the produced collagen fiber is optimal.

Secondly, it can be obtained from Embodiment 6 and Embodiments 8-13, the ratio range of the coagulation bath of the present application, that is, the ratio of protein solidifying agent, dehydrating agent, pH regulator and water, has little effect on the performance of collagen fibers, but the performance of collagen fibers prepared in Example 12 is the best.

Secondly, from Embodiment 12 and Embodiments 14-16, adding zinc salt will affect the properties of collagen fibers. Specifically, when the dehydrating agent is sodium salt or potassium salt, the spinning solution will disperse too quickly in the coagulation bath, resulting in excessive rigidity of the as-spun fiber and making the later fiber brittle, which is not conducive to spinnability. Adding zinc salt can ease the rapid dispersion of sodium and potassium ions and improve the tensile properties of the fiber. In addition, the collagen fiber prepared according to the ratio of Example 15 has the best performance.

Secondly, it can be seen from Embodiments 17-20 that different raw materials in the coagulation bath have little effect on the obtained collagen fibers. It shows that the production of this application is friendly to the selection of raw materials and is convenient for industrial production.

Secondly, it can be seen from Embodiment 15, Embodiment 21 and Embodiment 22 that the negative drafting parameters of the present application have little effect on the obtained collagen fibers. The preferred spin speed:bath separation speed is 1:0.7 for negative drafting.

Application Examples

The collagen fiber produced in Embodiment 15 of the present application can be used in non-woven fields such as facial masks, sanitary napkins, diapers, underarm patches, etc.;

The above-mentioned collagen fiber is used in textile fields such as underwear, socks, shorts, clothing fabrics and bedding, etc. Compared with general plant protein, collagen fiber is more suitable for spinning to produce protein fiber, and has excellent moisture retention, good affinity with human skin, and comfortable wearing. It is suitable for the development of bedding, shirts, knitted underwear, socks and other products.

The above-mentioned collagen fiber is used in medical fields such as band-aids, bandages, dressings, etc., and has good anti-seepage and healing functions.

The above-mentioned collagen fiber is used in the food field, such as preservatives in the food field, fruit preservation bags, etc. It can also be used in artificial leather.

The above-mentioned collagen fiber is used in paper industry: it is mainly in the form of fibers and combined with plant fibers to form composite products used to improve paper strength, water absorption, air permeability, tightness and whiteness, etc.

The above-mentioned collagen fiber is used in composite materials and nanomaterials, collagen fibers have good film-forming properties in addition to blending and spinning with other polymer materials.

It should be noted that when the collagen fiber of the present application is used in the above-mentioned fields, its weaving method is the same as that of materials such as polyester fiber known to those skilled in the art.

The above specific embodiments are only explanations of the present application and are not limitations of the present application. After reading this specification, those skilled in the art can make modifications to present embodiments without creative contribution as needed, but as long as it is within the scope of the claims of this application, they are protected by the patent law.

What is claimed is:

1. A method for preparing collagen fibers, comprising the following steps:

(1) preparing a spinning solution by soaking a collagen material in a solution with a pH of 3.5 to 5.5 to dissolve the collagen material, and then adjusting the pH to 9.9 to 12.5 to form the spinning solution; and (2) forming an as-spun fiber by coagulation-spinning the spinning solution in a coagulation bath having a pH of 4.4 to 6.8, wherein the coagulation bath comprises 8-12 wt % protein solidifying agent, 36-47 wt % dehydrating agent, and 0.8-3 wt % pH regulator.

2. The preparation method according to claim 1, wherein the coagulation bath further comprises 1.2-5 wt % zinc salt.

3. The preparation method according to claim 1, wherein the dehydrating agent is one or a mixture of sodium salt, potassium salt, and ammonium salt.

4. The preparation method according to claim 3, wherein the dehydrating agent is one or a mixture of several of sodium salt, potassium salt and ammonium salt;

wherein the sodium salt is one or a mixture of several of sodium sulfate, sodium chloride and sodium nitrate;

wherein the potassium salt is one or a mixture of several of potassium sulfate, potassium chloride and potassium nitrate; and wherein the ammonium salt is one or a mixture of several of ammonium sulfate, ammonium chloride and ammonium nitrate.

5. The preparation method according to claim 1, wherein the pH regulator is one or a mixture of several of sulfuric acid, hydrochloric acid and nitric acid.

6. The preparation method according to claim 2, salt is one or a mixture of several of zinc sulfate, zinc chloride and zinc nitrate.

7. The preparation method according to claim 1, wherein the solution of step (1) includes protease and water, and a mass ratio of the protease to the water is (0.2-0.5):(6-10).

8. The preparation method according to claim 7, wherein the mass ratio of the collagen material, protease and water is (1-2):(0.2-0.5):(6-10).

9. The preparation method according to claim 7, wherein the protease is one or a mixture of several of pepsin, trypsin and papain.

10. The preparation method according to claim 7, wherein the pH of the solution of step (1) is adjusted with weak acid, and the weak acid is carboxylic acid.

11. The preparation method according to claim 1, wherein in step (1), sodium hydroxide is used to adjust the pH of the spinning solution.

12. The preparation method according to claim 1, wherein the collagen material is prepared by soaking the collagen material in a sodium carbonate solution.

13. The preparation method according to claim 1, wherein in step (2), the as-spun fiber was negatively drawn in the coagulation bath according to the spinning speed:bath leaving speed of (1-1.5):(0.5-0.9).

* * * * *